US009820342B2

(12) United States Patent
Lee et al.

(10) Patent No.: US 9,820,342 B2
(45) Date of Patent: Nov. 14, 2017

(54) POWER SUPPLY APPARATUS FOR LED LIGHTING

(71) Applicant: LG INNOTEK CO., LTD., Seoul (KR)

(72) Inventors: Dong Soo Lee, Seoul (KR); Jong Hyun Lee, Seoul (KR); Kwang Jong Kim, Seoul (KR); Seok Yoon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/039,247

(22) PCT Filed: Nov. 26, 2014

(86) PCT No.: PCT/KR2014/011416
§ 371 (c)(1),
(2) Date: May 25, 2016

(87) PCT Pub. No.: WO2015/080462
PCT Pub. Date: Jun. 4, 2015

(65) Prior Publication Data

US 2017/0041993 A1 Feb. 9, 2017

(30) Foreign Application Priority Data

Nov. 26, 2013 (KR) ..... 10-2013-0144388
Nov. 26, 2013 (KR) ..... 10-2013-0144390
Nov. 26, 2013 (KR) ..... 10-2013-0144391

(51) Int. Cl.
*H05B 33/08* (2006.01)
*F21V 23/02* (2006.01)
(Continued)

(52) U.S. Cl.
CPC ..... *H05B 33/0809* (2013.01); *F21V 23/023* (2013.01); *F21V 23/06* (2013.01);
(Continued)

(58) Field of Classification Search
CPC ..... H05B 33/0884; H05B 3/0014; H05B 33/0809; F21V 23/023
(Continued)

(56) References Cited

U.S. PATENT DOCUMENTS 7,830,649 B2 * 11/2010 Yang ..... F21V 23/026 361/601
2009/0207543 A1 * 8/2009 Boniface ..... H02H 3/16 361/86
(Continued)

FOREIGN PATENT DOCUMENTS

KR 10-2009-0113232 A 10/2009
KR 10-2013-0026785 A 3/2013
(Continued)

OTHER PUBLICATIONS

Korea Illumination Industry Cooperative; "LED Light Engines"; Mar. 6, 2013 (English translation of scope and Full Korean Text).
(Continued)

*Primary Examiner* — Douglas W Owens
*Assistant Examiner* — Syed M Kaiser
(74) *Attorney, Agent, or Firm* — KED & Associates, LLP

(57) ABSTRACT

The present invention relates to a power supply apparatus for an LED lighting, comprising: a printed circuit board on which a circuit for converting input power into output power for driving the LED lighting is printed; an MCU, which comprises a driving voltage port, a ground port, and a voltage sensing port and is connected to the printed circuit board, for delivering control signals to the circuit so that a current applied to the LED lighting is converted based on a voltage inputted into the voltage sensing port; a first resistance of which one end is connected to the driving voltage port and the other end is connected to a voltage sensing node; a second resistance of which one end is connected to
(Continued)

the ground port and the other end is connected to the voltage sensing node; a sensing wire of which one end is connected to the voltage sensing port and the other end is connected to the voltage sensing node; a first wire of which one end is connected to one end of the first resistance and the other end is open; a second wire of which one end is connected to one end of the second resistance is the other end is open; a third wire including a third resistance wherein one end of the third resistance is connected to the voltage sensing node and the other end of the third resistance is open; and a housing provided with an inner space to which the printed circuit board, the MCU, the first resistance, the second resistance, the sensing wire, and one end of the first to third wires are coupled.

9 Claims, 12 Drawing Sheets

(51) Int. Cl.
*F21V 23/06* (2006.01)
*F21V 31/00* (2006.01)

(52) U.S. Cl.
CPC ..... *F21V 31/005* (2013.01); *H05B 33/0842* (2013.01); *H05B 33/0884* (2013.01)

(58) Field of Classification Search
USPC ..... 361/600, 601, 627, 633, 641, 644, 679, 361/651, 719, 717, 720, 748, 749, 760, 361/761; 315/307
See application file for complete search history.

(56) References Cited

U.S. PATENT DOCUMENTS

2011/0062888 A1* 3/2011 Bondy ..... H05B 33/0815 315/294
2013/0107584 A1 5/2013 Li et al.

FOREIGN PATENT DOCUMENTS

WO WO 2010/087675 A2 8/2010
WO WO 2010/127366 11/2010
WO WO 2010/150169 12/2010
WO WO 2011/136495 A2 11/2011

OTHER PUBLICATIONS

International Search Report (with English Translation and Written Opinion dated Feb. 16, 2015 issued in Application No. PCT/KR2014/011416.
European Search Report dated Jun. 20, 2017 issued in Application No. 14865046.8.

* cited by examiner (a)

(b)

POWER SUPPLY APPARATUS FOR LED LIGHTING

CROSS-REFERENCE TO RELATED PATENT APPLICATIONS

This application is a U.S. National Stage Application under 35 U.S.C. §371 of PCT Application No. PCT/KR2014/011416, filed Nov. 26, 2014, which claims priority to Korean Patent Application Nos. 10-2013-0144388, 10-2013-0144390, and 10-2013-0144391, all filed Nov. 26, 2013, whose entire disclosures are hereby incorporated by reference.

TECHNICAL FIELD

The present invention relates to an apparatus for supplying power to an LED light.

BACKGROUND ART

As society gradually evolves, the light industry requires various functions, such as individual and group control. Furthermore, as an environmental problem becomes serious, there is an increasing need for a light capable of reducing energy.

Accordingly, after a light-emitting diode (hereinafter referred to as an "LED") which is eco-friendly and has high energy efficiency was developed, there is a tendency that LED-related technologies become high efficiency very rapidly due to technology competitiveness, are spread into common light and high efficiency light markets due to the development of a white LED, continue to replace existing lights.

An LED driving circuit may implement various circuits depending on a design object. In this case, the LED driving circuit has a strong influence on efficiency of a driving circuit and the lifespan of an LED depending on uses, the driving characteristic of an LED, and the configuration of an LED array.

Meanwhile, in order to drive such an LED light, a power supply apparatus is commonly connected.

The power supply apparatus functions to receive external power and to convert the external power into power for driving the LED light. For example, a constant current type power supply apparatus converts an AC applied thereto into a direct current (DC) and supplies the DC to an LED light, that is, a light source.

As the range of use of an LED light is widened, a power supply apparatus for driving the LED light is designed in various ways from several tens of watts (W) to several hundreds of watts (W). To secure insulation with the outside becomes more important because a danger of an electric shock is increased as the capacity is increased.

Furthermore, as people's interest in lights recently gradually increases along with the improvement of quality of life, a current light device requires more than it turns on a light using a switch. That is, a current light device is developing into a more advanced form, such as producing various atmospheres depending on indoor uses or automatically adjusting luminous intensity properly depending on surrounding luminous intensity. A light device that evolves as described above is internationally used based on digital addressable lighting interface (DALI) communication.

DISCLOSURE

Technical Problem

An object of the present invention is to solve waste and inconvenience in which a power supply apparatus must be replaced when an LED light is replaced.

An object of the present invention is to show the same performance as that obtained when a power supply apparatus is replaced by connecting a separate resistor and changing impedance of a voltage sensing resistor (RSET) through a simple manipulation and to increase light management efficiency by minimizing a cost.

An object of the present invention is to enable a user to easily change an output current of a power supply apparatus through a simple manipulation in which a connector connected to the voltage sensing resistor (RSET) of the power supply apparatus is exposed to the outside and an external connector is inserted into the connector.

An object of the present invention is to prevent a short attributable to the erroneous connection of an external connector by designing an external shape so that the connector of a power supply apparatus and the external connector are engaged.

An object of the present invention is to prevent deterioration or aging attributable to moisture or an external impact and to reduce a danger of an electric shock by dually insulating a power wire included in a power supply apparatus for an LED light.

An object of the present invention is to prevent the penetration of moisture or dust into a housing and to block the leakage of a molding solution coated on the inside of the housing by shielding the space between a power wire and the housing through a gasket.

An object of the present invention is to improve the mobility of a power wire having a widened width through dual insulation by providing grooves in some region of a gasket coupled to the power wire, thereby facilitating the connection of the power wire and a circuit when a power supply apparatus is fabricated.

An object of the present invention is to implement digital control complying with different needs of users because a program for outputting a digital control signal is recorded on an MCU connected to a printed circuit board mounted on a power supply apparatus.

An object of the present invention is to freely change a program recorded on an MCU by mounting a connector connected to the MCU on a power supply apparatus, opening part of a housing so that the connector is exposed, and connecting an external terminal to the connector.

An object of the present invention is to protect parts of a power supply apparatus against an external environment, such as rainwater and dust, and to extend the lifespan of the power supply apparatus by inserting a gasket from the outside of a housing and connecting the gasket to a connector.

Technical Solution

In accordance with an aspect of the present invention, there is provided a power supply apparatus for an LED light, including a printed circuit board on which a circuit converting input power into output power for driving an LED light has been printed, an MCU which includes a driving voltage port, a ground port, and a voltage sensing port, which is connected to the printed circuit board, and which transfers a control signal for converting an electric current applied to the LED light to the circuit based on a voltage inputted to the voltage sensing port, a first resistor which has one end connected to the driving voltage port and has the other end connected to the voltage sensing node, a second resistor which has one end connected to the ground port and has the other end connected to the voltage sensing node, a sensing wire which has one end connected to the voltage sensing port and has the other end connected to the voltage sensing node, a first wire which has one end connected to the one end of the first resistor and has the other end open, a second wire which has one end connected to the one end of the second resistor and has the other end open, a third wire which includes a third resistor, wherein the third resistor has one end connected to the voltage sensing node and has the other end open, and a housing on which the printed circuit board, the MCU, the first resistor, the second resistor, the third resistor, and the sensing wire are mounted in the internal space of the housing.

Furthermore, an opening portion may be provided on one side of the housing, and the other ends of the first to the third wires may be extended to the outside of the housing through the opening portion.

Furthermore, the power supply apparatus may further include a gasket which is coupled to the stop portions of the first to the third wires and closely adheres to a designated area of the outer surface and inner surface of the opening portion.

Furthermore, the power supply apparatus may further include a first connector including a coupling unit to which the other ends of the first to the third wires are coupled and first to third guide grooves into which the pins of a second connector are inserted. The first to the third guide grooves may be extended up to the other ends of the first to the third wires, respectively.

Furthermore, at least one corner of the body of the first connector may be bent or protruded in response to a shape of the body of the second connector or at least one corner of the guide groove may be bent or protruded in response to a shape of the pin of the second connector so that an erroneous connection of the second connector is blocked.

Furthermore, the second connector includes first and second pins coupled together. The first pin may be inserted into the third guide groove, and the second pin may be inserted into any one of the first and the second guide grooves.

Furthermore, the first and the second pins may electrically connect the other end of the third wire to the other end of any one of the first wire and the second wire.

In accordance with another aspect of the present invention, there is provided a power supply apparatus for an LED light, including a printed circuit board on which a circuit converting input power into output power for driving an LED light has been printed, an MCU which includes a driving voltage port, a ground port, and a voltage sensing port, which is connected to the printed circuit board, and which transfers a control signal for converting an electric current applied to the LED light to the circuit based on a voltage inputted to the voltage sensing port, a first resistor which has one end connected to the driving voltage port and has the other end connected to the voltage sensing node, a second resistor which has one end connected to the ground port and has the other end connected to the voltage sensing node, a sensing wire which has one end connected to the voltage sensing port and has the other end connected to the voltage sensing node, a first wire which has one end connected to the one end of the first resistor and has the other end open, a second wire which has one end connected to the one end of the second resistor and has the other end open, a third wire which has one end connected to the voltage sensing node and has the other end open, and a housing on which the printed circuit board, the MCU, the first resistor, the second resistor, the third resistor, and the sensing wire may be mounted in an internal space of the housing.

Furthermore, the power supply apparatus may further include a first connector including a coupling unit to which the other ends of the first to the third wires are coupled and first to third guide grooves into which the pins of a second connector are inserted. The first to the third guide grooves may be connected to the other ends of the first to the third wires, respectively. The second connector may include a third resistor and first and second pins connected to both ends of the third resistor. The first pin may be inserted into the third guide groove. The second pin may be inserted into any one of the first and the second guide grooves.

Furthermore, the first and the second pins may electrically connect the other end of the third wire to the other end of any one of the first wire and the second wire.

In accordance with an aspect of the present invention, there is provided a power supply apparatus for an LED light having improved insulation performance, including a power wire which has one end connected to a printed circuit board, a printed circuit board on which a circuit for converting input power supplied by the power wire into output power for driving an exterior LED light has been printed, and a housing which accommodates the printed circuit board and includes an opening portion through which the other end of the power wire passes and which is drawn to the outside of the housing. The power wire includes a dual insulation unit and a power supply conductor connected to an external power source and isolated from the outside by the dual insulation unit.

Furthermore, the dual insulation unit may include first insulating means which is made of a first insulating material and surrounds the power supply conductor and second insulating means which is made of a second insulating material and surrounds the first insulating means.

Furthermore, the power supply apparatus may further include a gasket which is coupled to the circumference of the second insulating means and includes a fitting groove inserted into the edge of the opening portion. Furthermore, the gasket may further include reinforcement means which is connected to one of both sides of the gasket and surrounds the second insulating means in the length direction of the power wire. Furthermore, the reinforcement means may include a mobility groove for facilitating a bending of the power wire. Furthermore, the gasket may be made of PVC having a relative temperature index (RTI) of 90° C. Furthermore, a friction force corresponding to 5 kgf (kilogram-force) for 1 hour or more at 100° C. may be generated at a portion where the gasket and the second insulating means are coupled.

In accordance with an aspect of the present invention, there is provided a power supply apparatus for an LED light, including a printed circuit board on which a circuit converting input power into output power for driving an LED light has been printed, an MCU on which a program outputting a control signal for the LED light is recorded, which is connected to the printed circuit board, and which transfers the control signal to the circuit, a connector which has one side connected to an external terminal, has the other side connected to the MCU, and transfers a program conversion signal received from the external terminal to the MCU, and a housing which accommodates the printed circuit board, the MCU, and the connector and has an opening portion for connecting the external terminal and the connector on one side of the housing.

The connector may include a plurality of connector pins. A designated area between one side and the other side of the plurality of connector pins may have been subjected to bending processing. The connector may further include pin support means including a plurality of through holes spaced apart from each other at a designated interval. The number of through holes may be identical with the number of connector pins. Each of the connector pins may be coupled to the inside of each of the through holes, and one side and the other side of each of the connector pins may be protruded to the outside of the through hole. The power supply apparatus may further include a gasket including a body and a plurality of insertion grooves spaced apart from each other at an interval identical with the designated interval at one end of the body. The number of insertion grooves may be identical with the number of connector pins. The gasket may further include packing means extended from the other end of the body in a direction orthogonal to the length direction of the body. A separation groove may be provided on the inside of the packing means. The gasket may be made of a silicon-series compound. The connector may include first to fifth connector pins connected to the external terminal. The first connector pin may receive information about an operating frequency. The second connector pin may receive a program conversion signal synchronized with the operating frequency. The third connector pin may ground the external terminal and the MCU. The fourth connector pin may supply power to the external terminal. The fifth connector pin may receive a reset command for information recorded on the MCU.

Advantageous Effects

In accordance with an embodiment of the present invention, waste and inconvenience in which the power supply apparatus must be replaced when an LED light is replaced can be solved.

The same performance as that obtained when the power supply apparatus is replaced can be obtained by connecting a separate resistor and changing impedance of the voltage sensing resistor (RSET) through a simple manipulation, and thus light management efficiency can be increased because a cost is minimized.

A user can easily change an output current of the power supply apparatus through a simple manipulation for exposing the connector connected to the voltage sensing resistor (RSET) of the power supply apparatus to the outside and inserting an external connector into the connector.

A short attributable to the erroneous connection of an external connector can be prevented by designing an external shape so that the connector of the power supply apparatus and the external connector are engaged.

In accordance with an embodiment of the present invention, deterioration or aging attributable to moisture or an external impact can be prevented and a danger of an electric shock can be reduced by dually insulating the power wire included in the power supply apparatus for an LED light.

The penetration of moisture or dust into the housing can be prevented and the leakage of a molding solution coated on the inside of the housing can be blocked by shielding the space between the power wire and the housing through the gasket.

Since the grooves are provided in some region of the gasket coupled to the power wire, the mobility of the power wire having a widened width through dual insulation can be improved, and the connection of the power wire and the circuit can be easily connected when the power supply apparatus is fabricated.

In accordance with embodiments of the present invention, digital control complying with different needs of users can be implemented because a program for outputting a digital control signal is recorded on the MCU connected to the printed circuit board mounted on the power supply apparatus.

A program recorded on the MCU can be freely changed by mounting the connector connected to the MCU on the power supply apparatus, opening one side of the housing so that the connector is exposed, and connecting an external terminal to the connector.

Parts of the power supply apparatus can be protected against an external environment, such as rainwater and dust, and the lifespan of the power supply apparatus can be extended because the gasket is inserted from the outside of the housing and the gasket is connected to the connector.

MODE FOR INVENTION

Embodiments disclosed in this specification should not be interpreted as limiting or used to limit the scope of the present invention. It is evident to those skilled in the art that a description including the embodiments of this specification has various applications. Accordingly, unless otherwise defined by the claims, some embodiments described are illustrative for better understanding, and the scope of the present invention is not intended to be restricted by the embodiments. Furthermore, in describing the present invention, a detailed description of the known functions or constitutions will be omitted if it is deemed to make the gist of the present invention unnecessarily vague.

Hereinafter, embodiments of the present invention are described in more detail with reference to the accompanying drawings.

Figure 1:
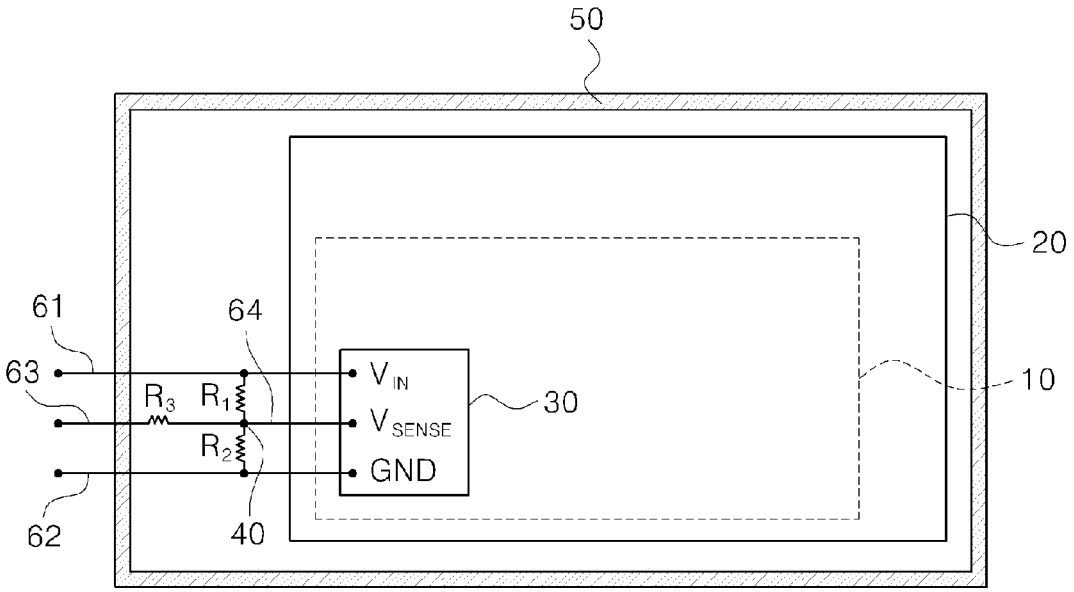
FIG. 1 is a plan view of a power supply apparatus for an LED light according to an embodiment of the present invention.

FIG. 1 is a plan view of a power supply apparatus for an LED light according to an embodiment of the present invention.

Referring to FIG. 1, the power supply apparatus for an LED light according to an embodiment of the present invention includes a printed circuit board 20, a microcontroller unit (MCU) 30, a first resistor R1, a second resistor R2, a sensing wire 64, a first wire 61, a second wire 62, a third wire 63, and a housing 50.

First, a circuit 10 means a circuit for converting external power into output power for driving an LED light connected to the power supply apparatus.

For example, a diode, an EMI filter, a capacitor, an inductor, a register, an integrated circuit (IC), a heat sink, a transistor, an operation amplifier, etc. may be included in the circuit.

The printed circuit board 20 means a thin plate which is electrically connected to the circuit 10 by soldering, etc. and to which the circuit 10 is fixed.

One side of the printed circuit board 20 is commonly used, but the present invention is not limited thereto. Both sides of the printed circuit board 20 may be used, if necessary.

The MCU 30 is a term meaning a non-memory semiconductor part which is responsible for the brain of an electronic product and controls various functions from a simple time schedule to a specific function. In the present invention, a program for outputting a control signal for an LED light is recorded on the MCU 30, and the MCU 30 is connected to the printed circuit board 20.

In particular, the MCU 30 includes a driving voltage port VIN, a voltage sensing port VSENSE, and a ground port GND. A driving voltage for driving the MCU 30 is applied to the driving voltage port VIN. Voltages that belong to the driving voltage applied to the driving voltage port VIN and that are divided by the first to the third resistors R3 are sensed at the voltage sensing port VSENSE. The MCU 30 is grounded through the ground port GND.

That is, the MCU 30 generates a control signal in accordance with a program for converting an electric current applied to the LED light based on a voltage inputted to the voltage sensing port VSENSE and transfers the control signal to the circuit 10.

For example, the MCU may generate a control signal which performs control so that an electric current of 700 mA is output when a voltage A is inputted to the voltage sensing port VSENSE, which performs control so that an electric current of 530 mA is output when a voltage B is inputted to the voltage sensing port VSENSE, and which performs control so that an electric current of 350 mA is output when a voltage C is inputted to the voltage sensing port VSENSE, and may transfer the generated control signal to the circuit 10.

A process in which a voltage applied to the voltage sensing port VSENSE is changed by the first to the third resistors R3 is described in more detail below.

The first resistor R1 and the second resistor R2 are elements which are basically included in order to divide a driving voltage.

Referring to FIG. 1, the first resistor R1 has one end connected to the driving voltage port VIN and the other end connected to a voltage sensing node 40. The second resistor R2 has one end connected to the ground port GND and the other end connected to the voltage sensing node 40. That is, in this case, the second resistor R2 functions as a voltage sensing resistor (RSET). Furthermore, the voltage sensing node 40 is a node at which the other ends of the first resistor R1 and the second resistor R2 are coupled together, and is connected to the voltage sensing port VSENSE through the sensing wire 64.

For example, it is assumed that a driving voltage applied to the driving voltage port VIN is 5 V (volts) and the first and the second resistors R1 and R2 are 10 kO (kilo-ohm). 2.5 V of the driving voltage is distributed to the other end of each of the first and the second resistors R1 and R2 according to the voltage distribution principle. The voltage sensing port VSENSE may detect 2.5 V applied across the second resistor R2.

The first wire 61 has one end connected to one terminal of the first resistor R1. The second wire 62 has one end connected to one end of the second resistor R2. The third wire 63 has one end connected to the voltage sensing node 40. Furthermore, the third wire 63 includes a third resistor R3 between one end and the other end. All of the other ends of the first to the third wires 61, 62, and 63 are open if they are not connected to an external connector (e.g., a second connector 200).

If the other ends of the first to the third wires 63 are open, the third resistor R3 included in the third wire 63 does not generate combined resistance along with the first resistor R1 and the second resistor R2. In contrast, if an external connector is connected, any two of the other ends of the first to the third wires 61, 62, and 63 are connected. Accordingly, the third resistor R3 is combined with any one of the first resistor R1 and the second resistor R2. As a result, a voltage applied across the second resistor R2 is changed and detected at the voltage sensing port VSENSE.

In general, the housing 50 is a term indicative of a box-shaped member that surrounds various parts or mechanical devices. In the present invention, the printed circuit board 20, the MCU 30, the first resistor R1, the second resistor R2, and one ends of the sensing wire 64 and the first to the third wires 61, 62, and 63 are mounted on the internal space of the housing 50.

Furthermore, as shown in FIG. 1, the printed circuit board 20, the MCU 30, the first resistor R1, the second resistor R2, and one ends of the sensing wire 64 and the first to the third wires 61, 62, and 63 may be mounted on the bottom surface of the housing 50, but the present invention is not limited thereto. They may be mounted on any place of the internal space of the housing 50.

Furthermore, the top surface, bottom surface, and side of the housing 50 may be combined in the state in which the housing has been separated into the top surface, the bottom surface, and the side, or the housing 50 may be an integration type.

Figure 2:
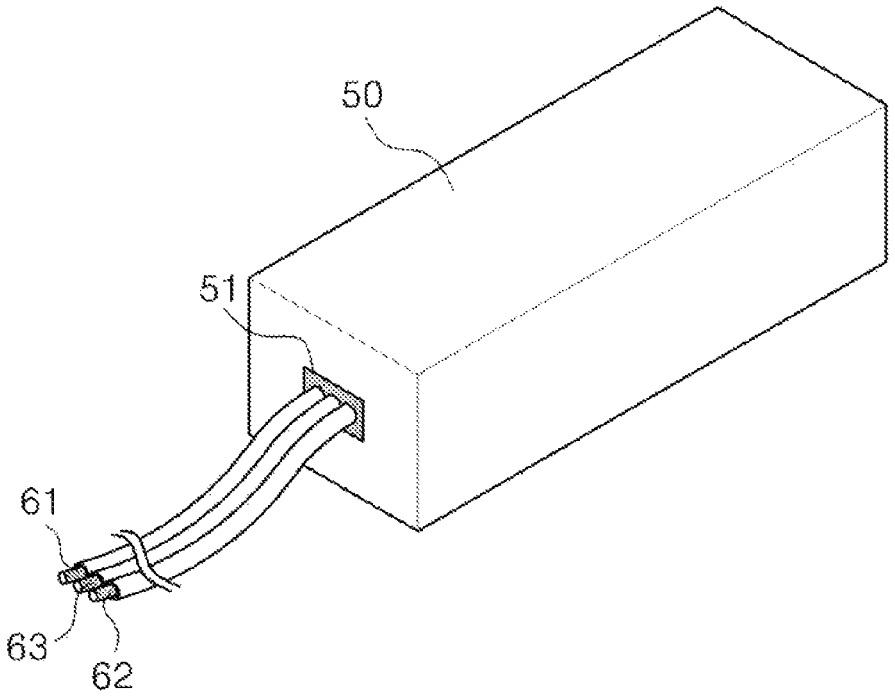
FIG. 2 is a perspective view of the power supply apparatus for an LED light according to an embodiment of the present invention.
Figure 3:
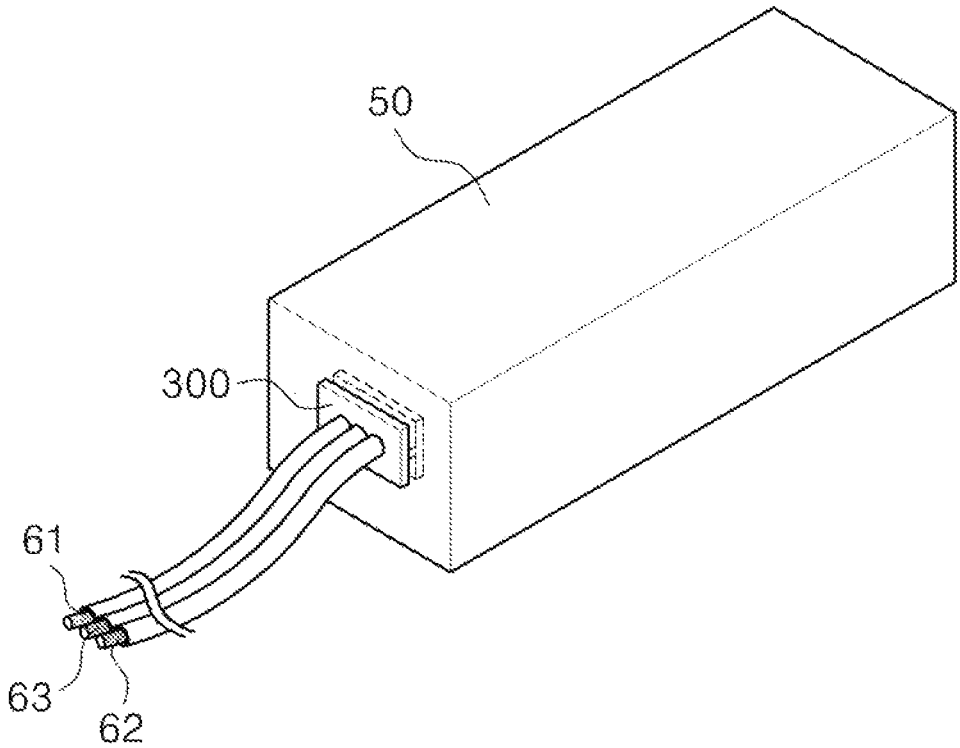
FIG. 3 is a perspective view of the power supply apparatus for an LED light according to an embodiment of the present invention.

FIGS. 2 and 3 are perspective views of the power supply apparatus for an LED light according to an embodiment of the present invention.

Referring to FIG. 2, the power supply apparatus for an LED light according to an embodiment of the present invention may include an opening portion 51 on one side of the housing 50. The opening portion 51 is an element for the connection of the first to the third wires 61, 62, and 63 and an external connector (e.g., the second connector 200).

That is, the other ends of the first to the third wires 61, 62, and 63 may be extended to the outside of the housing 50 so that they are connected to the external connector through the opening portion 51. In this case, the circumferences of the first to the third wires 63 may be surrounded by coating. The coating can protect the first to the third wires 63 against the generation of a short, an external impact, or heat.

Meanwhile, the power supply apparatus for an LED light according to an embodiment of the present invention may further include a gasket 300.

Referring to FIG. 3, the gasket 300 may be coupled to the stop portions of the first to the third wires 61, 62, and 63.

In general, the gasket 300 is means inserted so that gas or water does not leak from a contact surface between two fixed parts. In the present invention, a specific area of the stop portions of the first to the third wires 61, 62, and 63 may be sealed, and may closely adhere to a designated area of the outer surface and inner surface of the opening portion 51.

In this case, the materials of the gasket 300 may include silicon-series compounds, such as methyl hydrodien silicon, polydimethyl siloxane diol, epoxy-modified silicon oil, carboxyl-modified silicon, methacryl-modified silicon oil, alcohol-modified silicon, mercapto-modified silicon, vinyl-modified silicon, and amino-modified silicon.

The deformation of the first to the third wires 61, 62, and 63 is prevented by the gasket 300. In particular, if an LED light is for an outdoor use, although the power supply apparatus is installed outdoors, the lifespan of the power supply apparatus can be extended because rainwater or dust is prevented from permeating into the power supply apparatus through the opening portion 51 of the housing 50.

Figure 4:
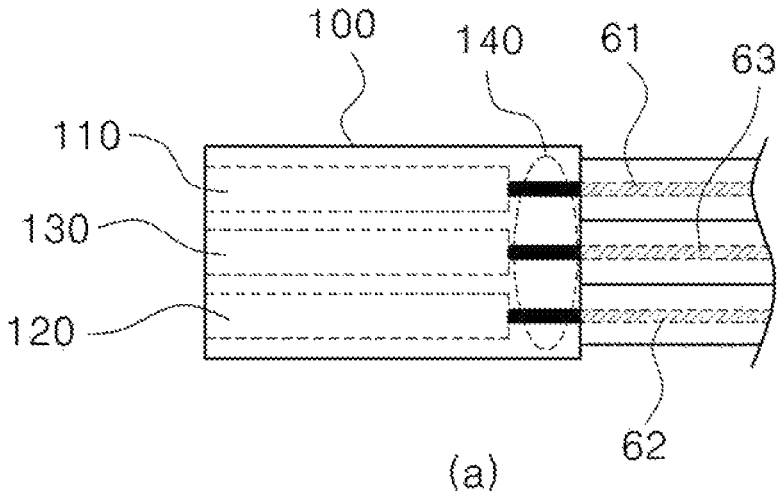
FIG. 4 is a plan view and front view of a first connector which is one element of the power supply apparatus for an LED light according to an embodiment of the present invention.
Figure 4:
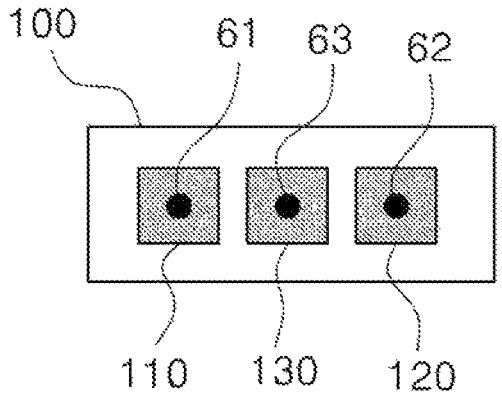

FIG. 4 is a plan view (a) and front view (b) of a first connector 100 which is one element of the power supply apparatus for an LED light according to an embodiment of the present invention.

Referring to FIG. 4, the power supply apparatus for an LED light according to an embodiment of the present invention may further include the first connector 100.

More specifically, the first connector 100 may include a coupling unit 140 to which the other ends of the first to the third wires 61, 62, and 63 are coupled and first to third guide grooves 110, 120, and 130 into which the pins 210 and 220 of the second connector 200 are inserted.

The coupling unit 140 is configured to surround some of the other ends of the first to the third wires 61, 62, and 63 at the same time, and functions to fix the other ends of the first to the third wires 61, 62, and 63.

In this case, the coupling unit 140 may have a form that directly surrounds the first to the third wires 61, 62, and 63, but is not limited thereto. The coupling unit 140 may have a form that surrounds coating to surround the first to the third wires 61, 62, and 63.

The first to the third guide grooves 110, 120, and 130 may have a form into which the pins 210 and 220 of the second connector 200 may be inserted and engaged.

The first to the third guide grooves 110, 120, and 130 may be connected to the other ends of the first to the third wires 61, 62, and 63, respectively, as shown in FIG. 4.

Accordingly, if the pin 210, 220 of the second connector 200 is inserted into at least any one of the first to the third guide grooves 110, 120, and 130, the pin 210, 220 of the second connector 200 may be electrically connected to at least any one of the other ends of the first to the third wires 61, 62, and 63.

Figure 5:
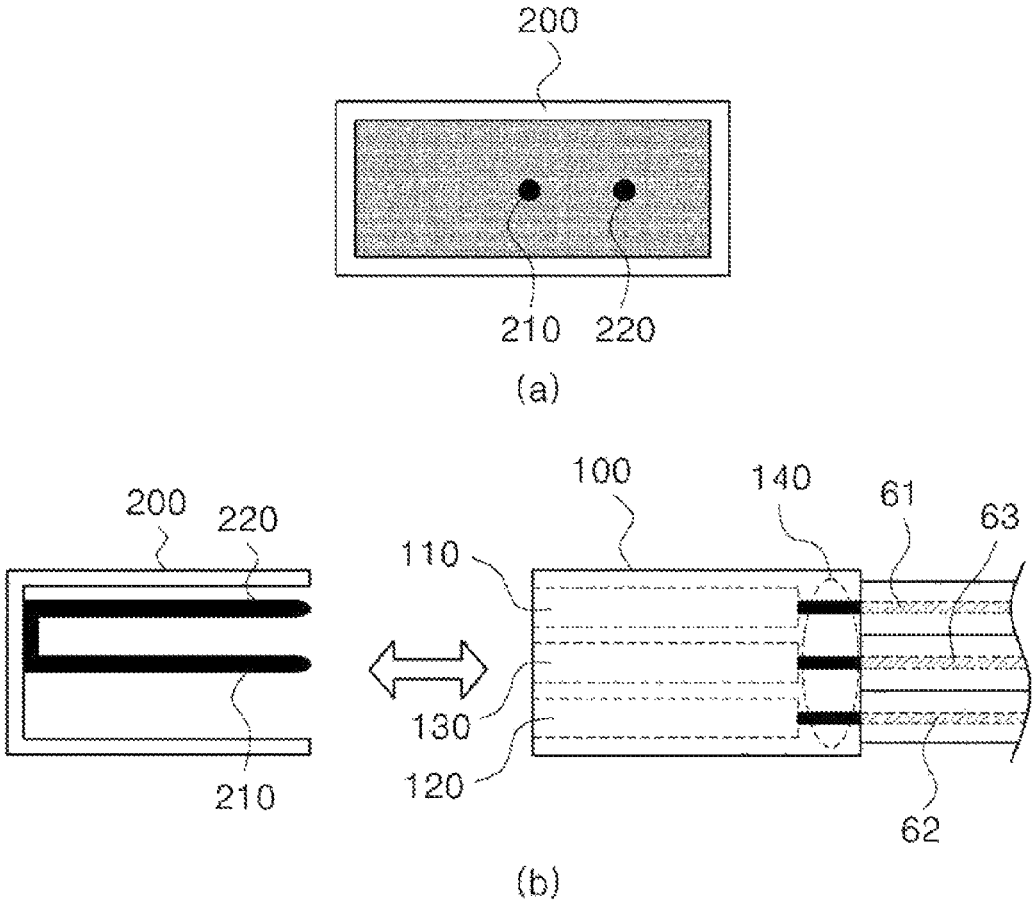
FIG. 5 is a front view and plan view of a second connector which is one element of the power supply apparatus for an LED light according to an embodiment of the present invention.

FIG. 5 is a front view and plan view of the second connector 200 which is one element of the power supply apparatus for an LED light according to an embodiment of the present invention.

Referring to FIG. 5, the second connector 200 which is connected to the first connector 100 and changes a voltage applied across the second resistor R2 according to the resistance composition principle and the voltage distribution principle may include a first pin 210 and a second pin 220.

In this case, the first pin 210 and the second pin 220 may have been electrically connected.

When the second pin 220 is inserted into any one of the first guide groove 110 and the second guide groove 120 in the state in which the first pin 210 has been inserted into the third guide groove 130, a voltage applied across the second resistor R2 may be changed.

That is, the first pin 210 and the second pin 220 form combined resistance by electrically connecting the other end of the third wire 63 to the other end of any one of the first wire 61 and the second wire 62.

For example, it is assumed that a driving voltage applied to the driving voltage port VIN is 5 V (volts), each of the first to the third resistors R3 has 10 kO, and the second pin 220 has been inserted into the first guide groove 110 in the state in which the first pin 210 has been inserted into the third guide groove 130. In this case, the first resistor R1 and the third resistor R3 become a parallel connection state and have combined resistance of 5 kO. About 3.33 V is applied across the second resistor R2 connected to the first resistor R1 and the third resistor R3 in series.

If the second pin 220 is inserted into the second guide groove 120, the second resistor R2 and the third resistor R3 become a parallel connection state and have combined resistance of 5 kO. The driving voltage of 5 V is divided by the first resistor R1 of 10 kO and the combined resistance of 5 kO, and thus about 1.67 V is applied across the second resistor R2.

Accordingly, the MCU 30 may detect a changed voltage across the second resistor through the voltage sensing port VSENSE, and may select or adjust the amount of an electric current supplied to the LED light side.

Figure 6:
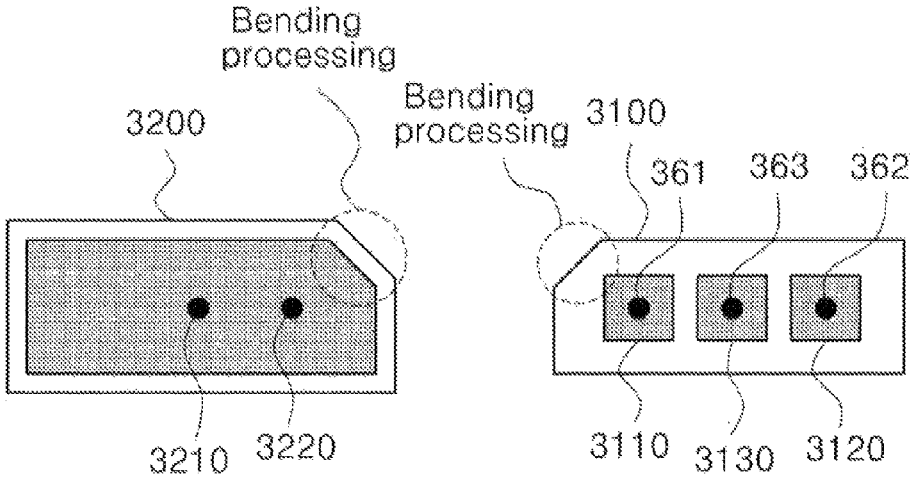
FIG. 6 is a front view of the first connector and the second connector which are elements of the power supply apparatus for an LED light according to an embodiment of the present invention.

FIG. 6 is a front view of the first connector 100 and the second connector 200 which are elements of the power supply apparatus for an LED light according to an embodiment of the present invention.

Referring to FIG. 6, at least one corner of the first connector 100, that is, one element of the power supply apparatus for an LED light according to an embodiment of the present invention, may be bent or protruded in response to a shape of the body of the second connector 200. Alternatively, at least one corner of the first to the third guide grooves 110, 120, and 130 may be bent or protruded in response to a shape of the pins 210 and 220 of the second connector 200.

Accordingly, only when the bent or protruded portion of the body of the first connector 100 or the pin is a direction corresponding to a shape of the second connector 200, the first connector 100 and the second connector 200 are accurately engaged. Accordingly, a problem in that an unwanted current is supplied to an LED light or a short is generated because the second connector 200 is inserted in a wrong direction can be prevented.

Figure 7:
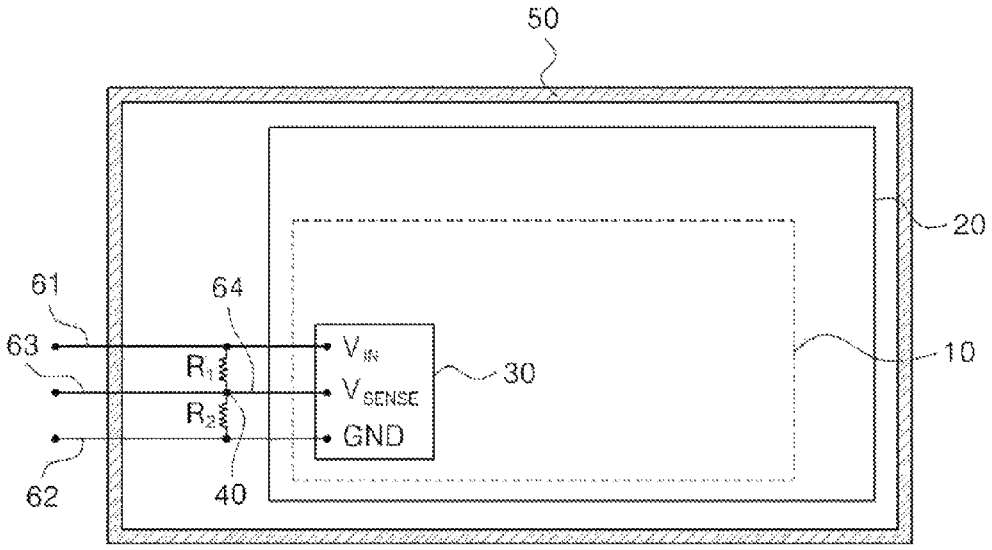
FIG. 7 is a plan view of a power supply apparatus for an LED light according to an embodiment of the present invention.
Figure 8:
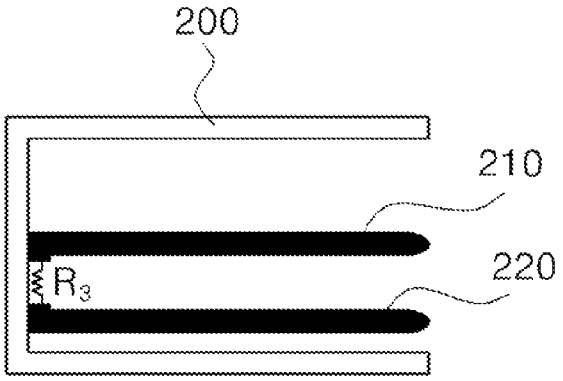
FIG. 8 is a plan view of a second connector which is one element of the power supply apparatus for an LED light according to an embodiment of the present invention.

FIG. 7 is a plan view of a power supply apparatus for an LED light according to an embodiment of the present invention, and FIG. 8 is a plan view of a second connector which is one element of the power supply apparatus for an LED light according to an embodiment of the present invention.

Referring to FIG. 7, compared to FIG. 1, the third wire 63 does not include the third resistor R3. That is, the third wire 63 may have one end connected to the voltage sensing node 40 and may have the other end open and coupled to the first connector 100.

Referring to FIG. 8, compared to FIG. 5, the second connector 200 may further include the third resistor R3 in addition to the first pin 210 and the second pin 220. The first pin 210 and the second pin 220 may be connected to both ends of the third resistor R3. That is, the first pin 210 is electrically connected to the second pin 220 through the third resistor R3.

Since the third resistor R3 included in the third wire 63 is included in the second connector 200, the same effects as those of the embodiment described with reference to FIGS. 1 and 5 are generated.

For example, it is assumed that a driving voltage applied to the driving voltage port VIN is 5 V (volts), each of the first to third resistors R3 is 10 kO, and the second pin 220 has been inserted into the first guide groove 110 in the state in which the first pin 210 has been inserted into the third guide groove 130. In this case, the first resistor R1 and the third resistor R3 become a parallel connection state and have combined resistance of 5 kO. About 3.33 V is applied across the second resistor R2 connected to the first resistor R1 and the third resistor R3 in series in accordance with the voltage distribution principle.

If the second pin 220 is inserted into the second guide groove 120, the second resistor R2 and the third resistor R3 become a parallel connection state and have combined resistance of 5 kO. The driving voltage of 5 V is divided by the first resistor R1 of 10 kO and the combined resistance of 5 kO, and thus about 1.67 V is applied across the second resistor R2.

That is, the first pin 210 and the second pin 220 may form combined resistance by electrically connecting the other end of the third wire 63 to the other end of any one of the first wire 61 and the second wire 62.

Figure 9:
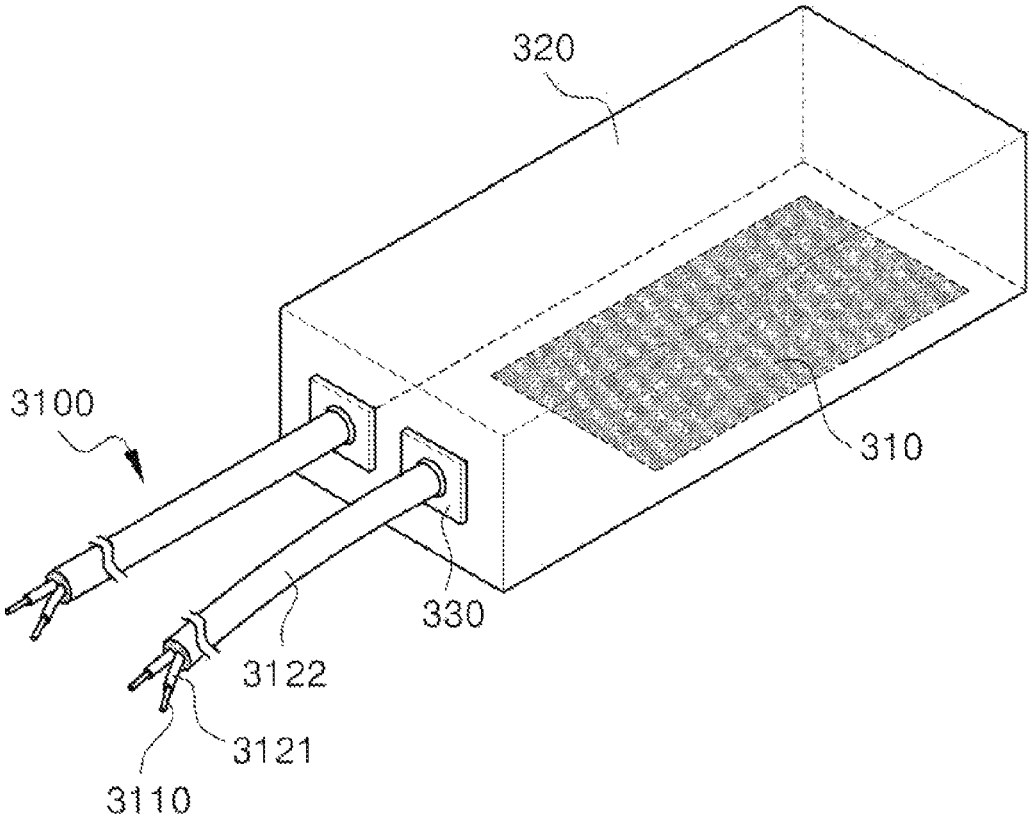
FIG. 9 is a perspective view of a power supply apparatus for an LED light having an improved insulating property according to an embodiment of the present invention.
Figure 10:
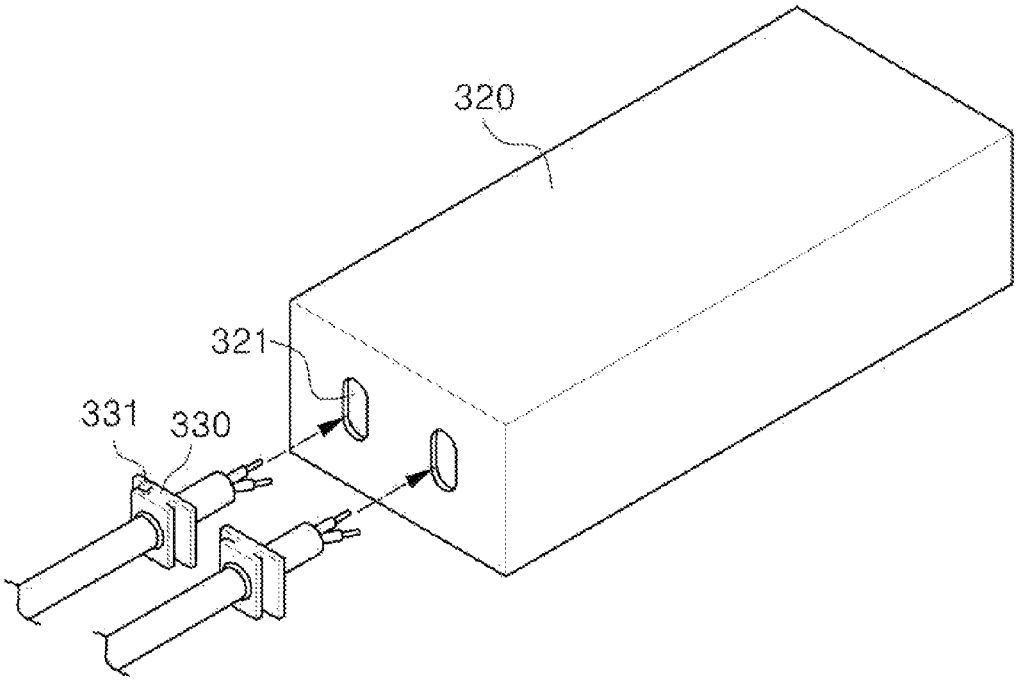
FIG. 10 is a perspective view of the power supply apparatus for an LED light having an improved insulating property according to an embodiment of the present invention.

FIG. 9 is a perspective view of a power supply apparatus for an LED light having an improved insulating property according to an embodiment of the present invention, and FIG. 10 is a perspective view of the power supply apparatus for an LED light having an improved insulating property according to an embodiment of the present invention.

Referring to FIGS. 9 and 10, the power supply apparatus for an LED light having an improved insulating property according to an embodiment of the present invention includes a printed circuit board 310, a housing 320, and a power wire 3100.

First, the power wire 3100 has one end connected to the printed circuit board 310 and the other end connected to an external power source or an LED light. That is, in accordance with an embodiment of the present invention, the power wire 3100 may be used for input and output. The input power wire 3100 and the output power wire 3100 may be the same. Accordingly, the input power wire 3100 is chiefly described below.

The printed circuit board 310 means a thin plate which is electrically connected to a circuit 311 by soldering, etc. and to which the circuit 311 is fixed.

The circuit 311 converts input power, supplied by the power wire 3100, into output power for driving an external LED light. For example, the circuit 311 of a constant current type power supply apparatus may convert an AC into a DC.

The circuit 311 may be configured to include a diode, an EMI filter, a capacitor, an inductor, a register, an integrated circuit 311 (IC), a heat sink, a transistor, an operation amplifier, etc.

One side of the printed circuit board 310 is commonly used, but the present invention is not limited thereto. Both sides of the printed circuit board 310 may be used.

In general, the housing 320 is a term indicative of a box-shaped member that surrounds various parts or mechanical devices. In the present invention, the printed circuit board 310 is mounted on the internal space of the housing 320, and the housing 320 functions to shield the printed circuit board 310 from the outside. Furthermore, a silicon molding solution may be coated on the inside of the housing 320. The silicon molding solution functions to uniformly distribute heat, generated in a process of converting, by the circuit 311, power, to the internal space of the housing 320. Furthermore, an opening portion through which the other end of the power wire 3100 passes and which is drawn to the outside of the housing 3320 is provided on one side of the housing 320.

Referring to FIGS. 9 and 10, the power wire 3100 includes a dual insulation unit 3120 and a power supply conductor 3110.

The power supply conductor 3110 may be connected to an external power source directly or through another conductor. Furthermore, the power supply conductor 3110 is isolated from the outside by the dual insulation unit 3120. That is, the dual insulation unit 3120 has a form that surrounds a middle end portion other than some region of both ends of the power supply conductor 3110 in a length direction.

More specifically, the dual insulation unit 3120 includes first insulating means 3121 and second insulating means 3122.

The first insulating means 3121 is made of a first insulating material 3123 and is configured to surround the power supply conductor 3110. The second insulating means 3122 is made of a second insulating material 3124 and is configured to surround the first insulating means 3121. That is, the power supply conductor 3110 may be covered with the first insulating means 3121, and the first insulating means 3121 may be covered with the second insulating means 3122. Such covering may be performed by an extrusion molding method.

The first insulating material 3123 and the second insulating material 3124 may include one or a combination of two or more of insulating materials, such as polyethylene resin, crosslinked polyethylene, polybuthylene terephthanlate, crosslinked polyolefin, a thermoplastic polyester copolymer, ethylene propylene rubber, co-poly (ether-ester) resin, co-poly (ester-ester) resin, PVC, a silicon-series compound, and polypropylene.

Meanwhile, the first insulating material 3123 and the second insulating material 3124 may be made of the same material or different materials.

If the first insulating material 3123 and the second insulating material 3124 are made of different materials, the first insulating means 3121 and the second insulating means 3122 are not united, but come in contact with each other in the separate state due to a difference between the physical properties of the first and the second insulating materials. Accordingly, there is an advantage in that the second insulating means 3122 can be easily peeled off from the first insulating means 3121 when a task for connecting the end of the power wire 3100 to an external power source or an LED light is performed.

The power supply apparatus for an LED light having an improved insulating property according to an embodiment of the present invention may further include a gasket 330. The gasket 330 may be coupled to the circumference of the second insulating means 3122, as shown in FIGS. 9 and 10.

In general, the gasket 330 is means inserted so that gas or water does not leak from a contact surface between two fixed parts. In the present invention, the gasket 330 shields the space between the power wire 3100 and an opening portion. In this case, the gasket 330 may be made of PVC. Furthermore, if the gasket 330 is made of PVC, it may have a relative temperature index (RTI) of 90° C. or more. The relative temperature index (RTI) is an evaluation index for a long-term heat-resistant temperature of plastic. For example, RTI 90° C. means that physical properties measured after a use for continuous 60,000 hours at a temperature of 90° C. maintain 50% of the first physical properties.

Figure 11:
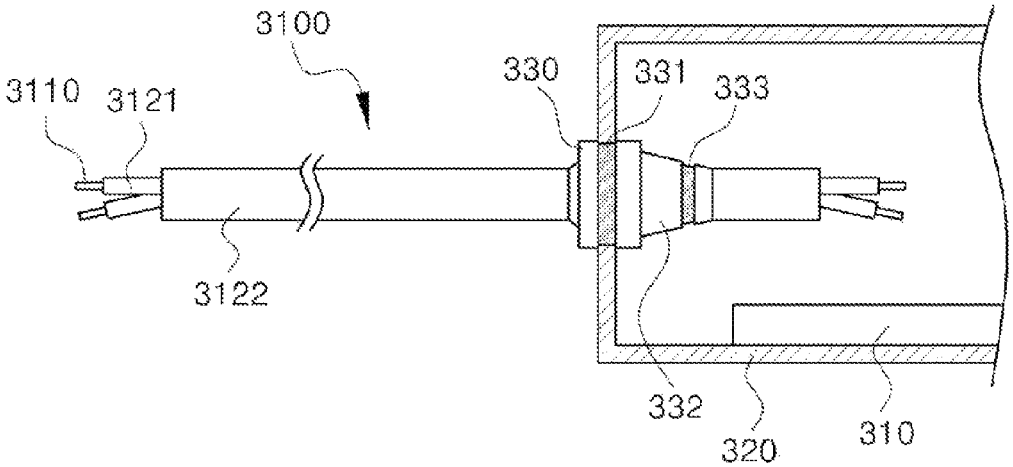
FIG. 11 is a diagram showing the state in which a power wire and a gasket have been coupled together according to an embodiment of the present invention.

FIG. 11 is a diagram showing the state in which the power wire 3100 and the gasket 330 have been coupled together according to an embodiment of the present invention.

The gasket 330 may include a fitting groove 331 corresponding to a shape of the opening portion, as shown in FIGS. 10 and 11. The fitting groove 331 is combined with the shape of the opening portion, and the body of the gasket 330 closely adheres to a designated area of the inner surface and outer surface of the housing 320 on the circumference of the opening portion.

If the power wire 3100 is fixed by the gasket 330 and an LED light is for an outdoor use, such as a streetlight or a signboard, the lifespan of the power supply apparatus can be extended because rainwater or dust is prevented from permeating into the housing 320 although the power supply apparatus is installed outdoors. Furthermore, the gasket 330 can also prevent the silicon molding solution coated on the inside of the housing 320 from leaking to the outside of the housing 320.

Furthermore, the gasket 330 may further include reinforcement means 332. The reinforcement means 332 is an element for increasing a friction force between the power wire 3100 and the gasket 330. Accordingly, the reinforcement means 332 can prevent a physical impact from being applied to the circuit 311 because the power wire 3100 and the gasket 330 are decoupled by an external force, etc.

Referring to FIG. 11, the reinforcement means 332 may be connected to one side of the gasket 330 placed within the housing 320 when the gasket 330 and the housing 320 are coupled. Furthermore, the reinforcement means 332 may have a shape that surrounds the second insulating means 3122 in the length direction of the power wire 3100 (i.e., the direction directed from one end to the other end).

A portion at which the gasket 330 and the second insulating means 3122 are coupled may be designed so that a friction force opposing 5 kgf (kilogram-force) for 1 hour or more at 100° C. is generated at the portion.

Figure 12:
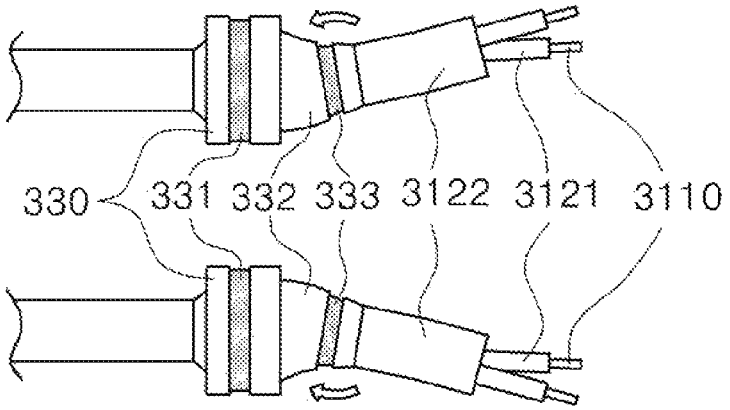
FIG. 12 is a diagram showing that the power wire having the gasket coupled thereto may be easily bent by a mobility groove in accordance with an embodiment of the present invention.

FIG. 12 is a diagram showing that the power wire 3100 having the gasket 330 coupled thereto may be easily bent by a mobility groove 333 in accordance with an embodiment of the present invention.

Referring to FIG. 12, the reinforcement means 332 may be equipped with the mobility groove 333. The mobility groove 333 is an element for facilitating bending (i.e., increasing the bending range) without applying damage to the power supply conductor 3110, the first insulating means 3121, or the second insulating means 3122 included in the power wire 3100.

The width of the entire power wire 3100 dually insulated by the first insulating means 3121 and the second insulating means 3122 is widened. Thus, there is a possibility that the range that the power wire 3100 is bent is limited and the power wire 3100 may be broken if an external force is intentionally applied to the power wire 3100. Since the mobility groove 333 is included in the reinforcement means 332, the mobility of the power wire 3100 can be increased and connection easiness with the circuit 311 when the power supply apparatus is fabricated is increased, thereby being capable of improving production efficiency.

Figure 13:
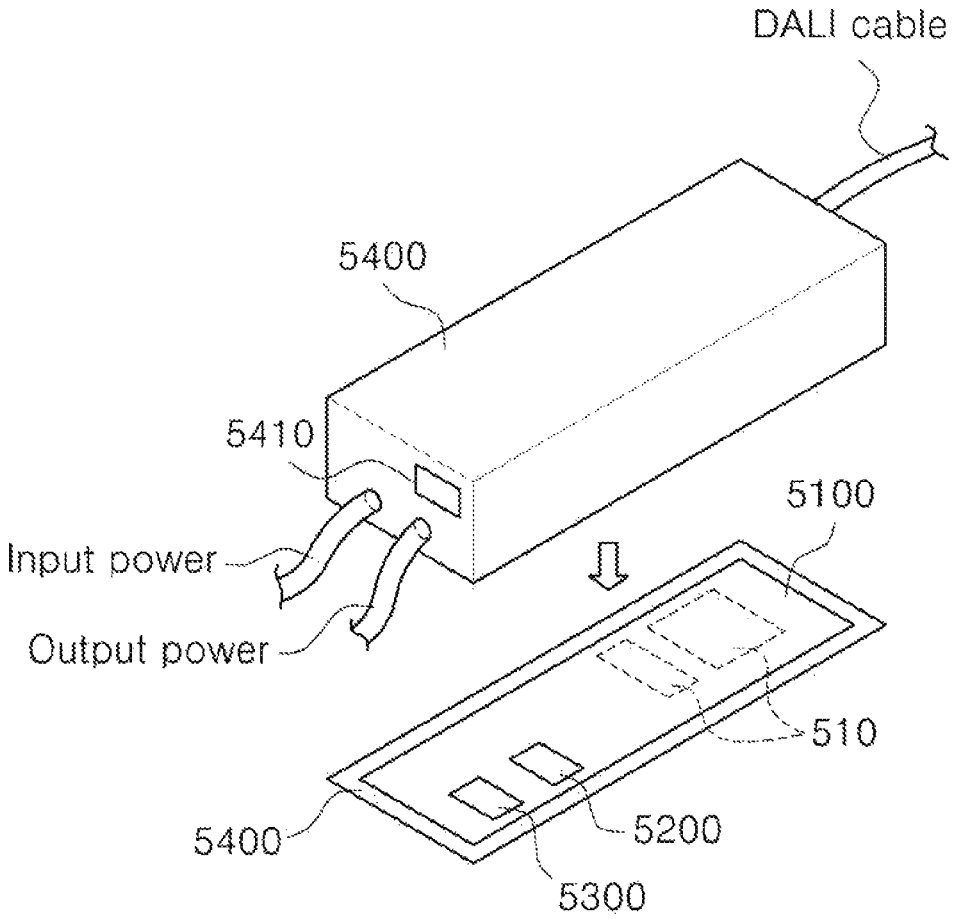
FIG. 13 is a perspective view of a power supply apparatus for an LED light according to an embodiment of the present invention.

FIG. 13 is a perspective view of a power supply apparatus for an LED light according to an embodiment of the present invention.

Referring to FIG. 13, the power supply apparatus for an LED light according to an embodiment of the present invention includes a circuit 510, a printed circuit board 5100, an MCU 5200, a connector 5300, and a housing 5400.

First, the circuit 510 means a circuit which converts input power into output power for driving an LED light.

For example, a diode, an EMI filter, a capacitor, an inductor, a register, an integrated circuit (IC), a heat sink, a transistor, an operation amplifier, etc. may be included in the circuit 510.

The printed circuit board 5100 means a thin plate which is electrically connected to the circuit 510 by soldering, etc. and to which the circuit 510 is thus fixed.

One side of the printed circuit board 5100 is commonly used, but the present invention is not limited thereto. Both sides of the printed circuit board 5100 may be used, if necessary.

The micro controller unit (MCU) 5200 is an element that plays the role of the brain of an electronic product, and is a term meaning a non-memory semiconductor part which controls various functions from a simple time schedule to a special function. In the present invention, a program for outputting a control signal for an LED light is recorded on the MCU 5200, and the MCU 5200 is connected to the printed circuit board 5100.

That is, the control signal output in accordance with the recorded program is transferred to the circuit 510 through the printed circuit board 5100 so that a target function is implemented.

The connector 5300 may be connected to an external terminal, and is an element which transfers a program conversion signal received from the external terminal to the MCU 5200.

That is, the connector 5300 functions to relay data between the external terminal and the MCU 5200. In this case, the external terminal may be a DALI interface which is connected to a terminal device, such as a specific user's PC, and supports DALI communication.

More specifically, the connector 5300 has one side connected to the external terminal and the other side connected to the MCU 5200. In this case, the other side may be directly connected to the MCU 5200 or may be connected to the MCU 5200 via the pattern of the printed circuit board 5100 or the circuit 510.

In general, the housing 5400 is a term indicative of a box-shaped member that surrounds various parts or mechanical devices. In the present invention, the housing 5400 may accommodate the printed circuit board 5100, the MCU 5200, and the connector.

Furthermore, as shown in FIG. 13, the printed circuit board 5100, the MCU 5200, and the connector may be mounted on the bottom surface of the housing 5400, but the present invention is not limited thereto. They may be mounted on any place within the space provided by the housing 5400.

Furthermore, the top surface, bottom surface, and side of the housing 5400 may be combined in the state in which the housing has been separated into the top surface, bottom surface, and side, or the housing 5400 may be an integration type.

Meanwhile, in accordance with an embodiment of the present invention, an opening portion 5410 may be provided on one side of the housing 5400. The opening portion 5410 is an element for the connection of an external terminal and the connector 5300.

There is an advantage in that conventional problems are solved because a digital control program having various functions complying with different user needs can be installed through the connector, the MCU 5200, and the opening portion 5410.

Figure 14:
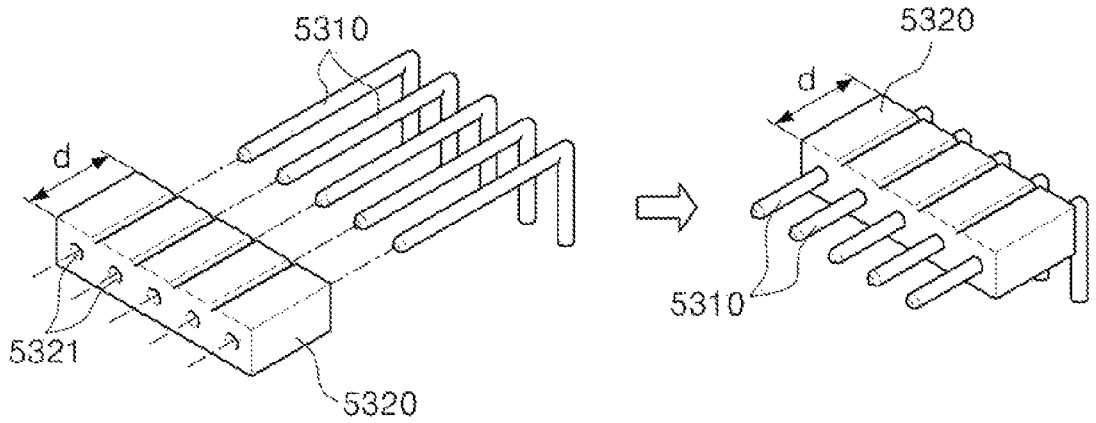
FIG. 14 is a perspective view of connectors included in the power supply apparatus for an LED light according to an embodiment of the present invention.

FIG. 14 is a perspective view of the connector 5300 included in the power supply apparatus for an LED light according to an embodiment of the present invention.

Referring to FIG. 14, the connector 5300 included in the power supply apparatus for an LED light according to an embodiment of the present invention may include a plurality of connector pins 5310.

Each of the plurality of connector pins 5310 included in the connector 5300 may be subjected to bending processing, as shown in FIG. 14.

A ratio of the length from such a bending-processed area to one side and the other side may be 2:1, for example, but is not limited thereto.

Since the connector pins 5310 are subjected to bending processing, one sides of the connector pins 5310 can be placed in parallel to the bottom surface of the housing 5400 and exposed through the opening portion 5410 when the connector 5300 is fully mounted on the inside of the housing 5400 of the power supply apparatus. Accordingly, there is an advantage in that a connection with an external terminal is facilitated.

Furthermore, the connector 5300 may further include pin support means 5320. The pin support means 5320 is an element for preventing deformation of the plurality of connector pins 5310, such as curve or bending attributable to an external impact, etc. by supporting each of the plurality of connector pins 5310.

Furthermore, the pin support means 5320 can prevent the generation of a data transmission error or a short by blocking a contact between the connector pins 5310.

More specifically, referring to FIG. 14, the pin support means 5320 includes a plurality of through holes 5321 spaced apart from each other at a designated interval. The through hole 5321 means a hole that penetrates one side and the other side of the pin support means 5320 in the length direction.

Furthermore, the through hole 5321 may be a circle, but is not limited thereto. The through hole 5321 may have a shape capable of supporting the connector pin 5310 when the connector pin 5310 is inserted into the through hole 5321.

The number of through holes 5321 may be the same as or greater than the number of connector pins 5310.

In this case, as shown in FIG. 14, some area between one side and the other side of each of the connector pins 5310 may be coupled to and surrounded by the inside of the through hole 5321 by the length d of the pin support means 5320. One side and the other side of each of the connector pins 5310 may be protruded to the outside of the through hole 5321.

That is, one side of the connector pin 5310 protruded to the outside of the through hole 5321 may be connected to an external terminal, and the other side thereof may be connected the printed circuit board 5100, the circuit 510, or the MCU 5200.

Furthermore, the plurality of connector pins 5310 may be first to fifth connector pins 5310. The first connector pin 5310 connected from an external terminal connected to the connector 5300 may receive information about an operating frequency. The second connector pin 5310 may receive a program conversion signal synchronized with the operating frequency received through the first connector pin 5310. The third connector pin 5310 may ground the external terminal and the MCU 5200. The fourth connector pin 5310 may supply power to the external terminal. The fifth connector pin 5310 may receive a reset command for information recorded on the MCU 5200.

Figure 15:
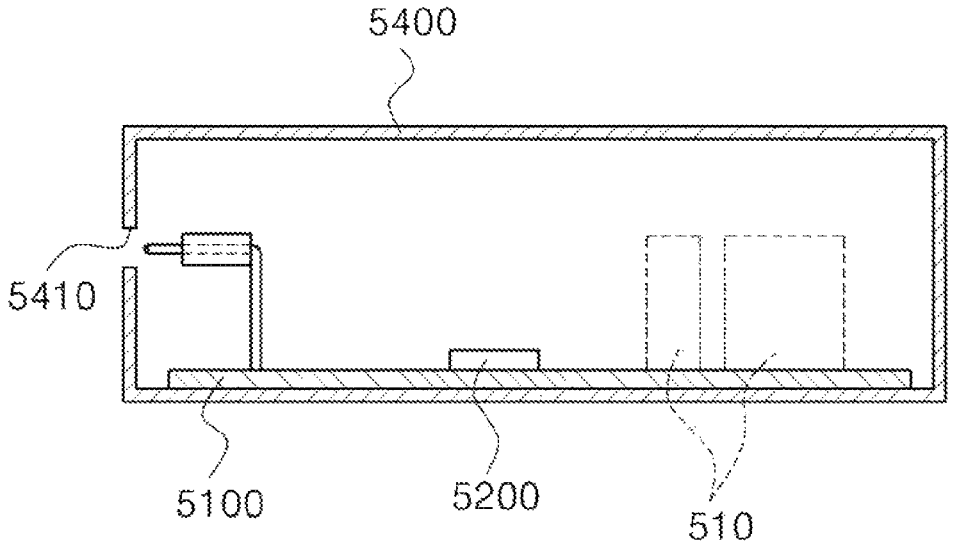
FIG. 15 is a side view of the power supply apparatus for an LED light according to an embodiment of the present invention.
Figure 16:
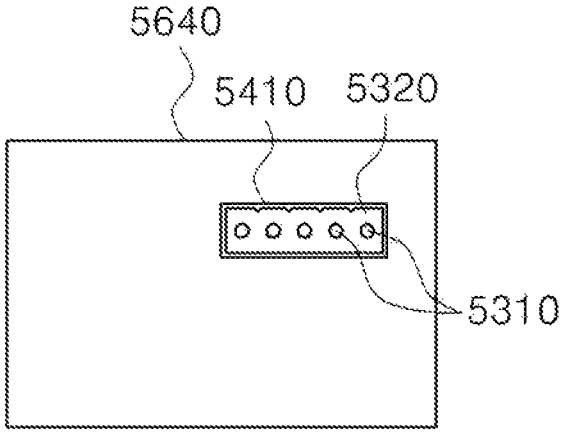
FIG. 16 is a front view of the power supply apparatus for an LED light according to an embodiment of the present invention.

FIG. 15 is a side view of the power supply apparatus for an LED light according to an embodiment of the present invention, and FIG. 16 is a front view of the power supply apparatus for an LED light according to an embodiment of the present invention.

From FIGS. 15 and 16, the power supply apparatus for an LED light in which the printed circuit board 5100, the circuit 510, the MCU 5200, and the connector 5300 have been mounted on the inside of the housing 5400 in accordance with an embodiment of the present invention may be checked.

Furthermore, the connector pins 5310 are subjected to bending processing, and one side of each of the connector pins 5310 is placed in parallel to the bottom surface of the housing 5400 and thus exposed through the opening portion 5410.

Meanwhile, FIG. 15 illustrates that the other side of each of the connector pins 5310 has been directly connected to the printed circuit board 5100, but is not limited thereto. The other side of the connector pin 5310 may be interpreted as being connected to the MCU 5200 or the circuit 510.

Figure 17:
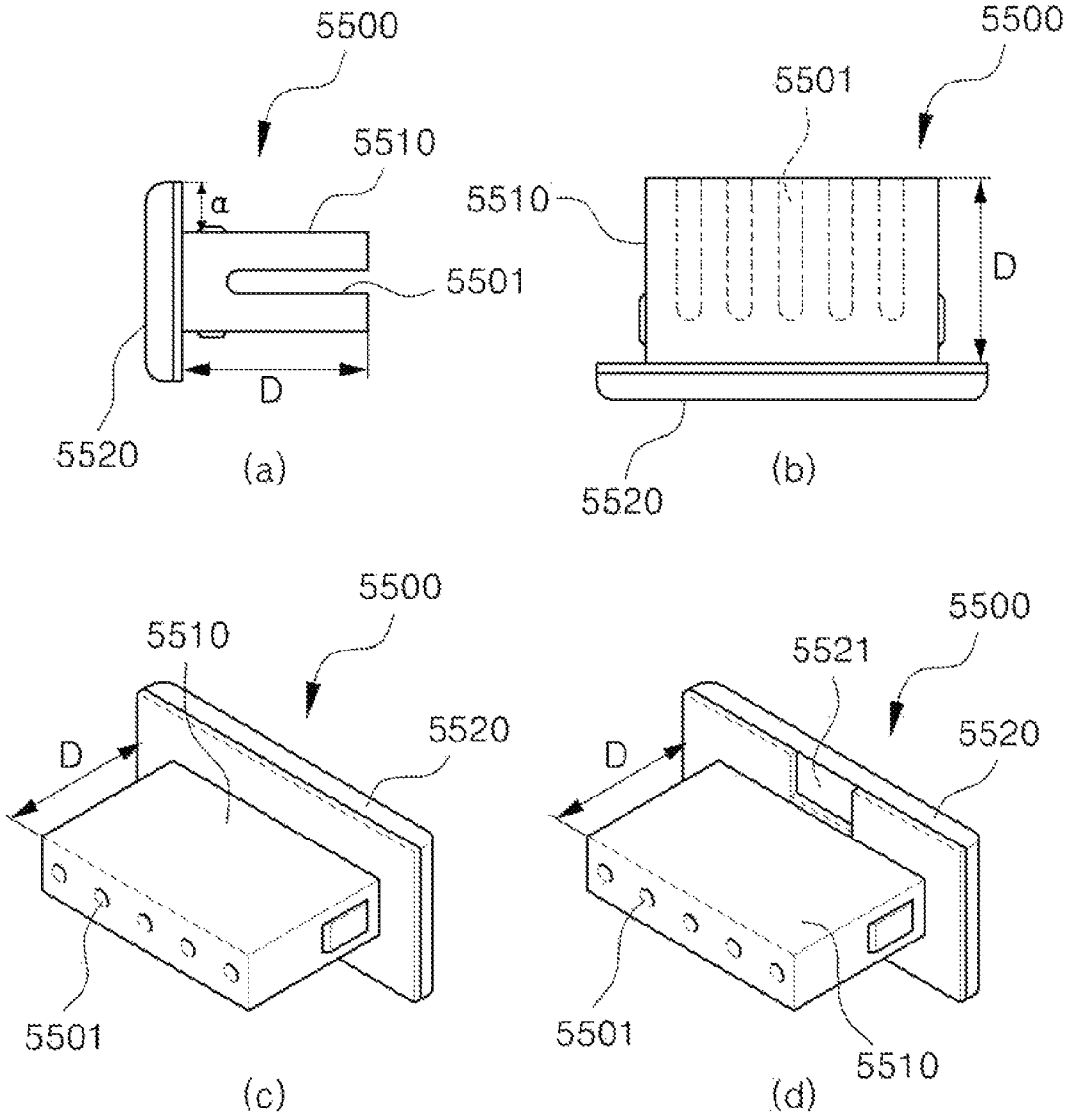
FIG. 17 is a side view, front view, and perspective view of a gasket included in the power supply apparatus for an LED light according to an embodiment of the present invention.
Figure 18:
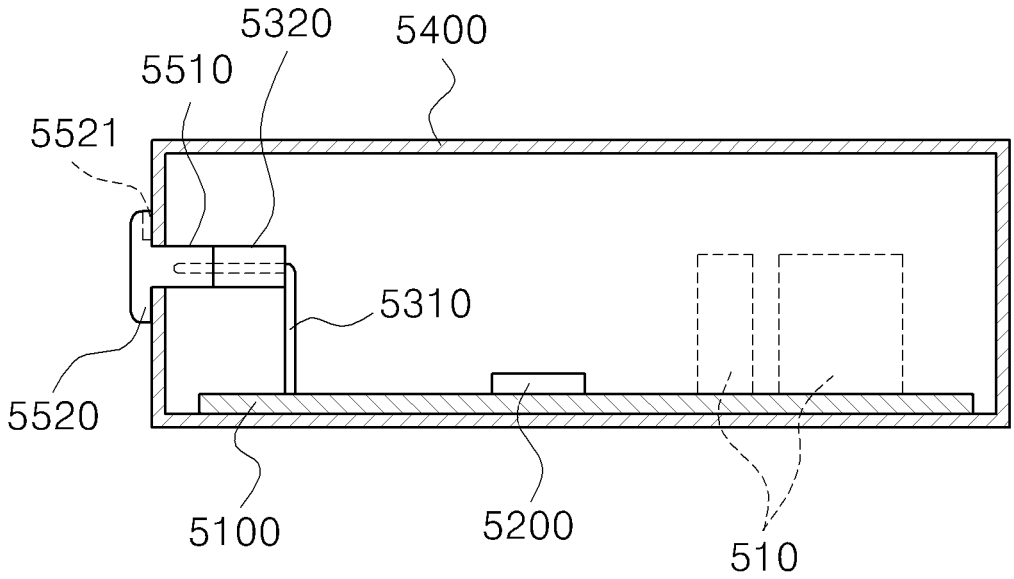
FIG. 18 is a side view of a power supply apparatus for an LED light according to another embodiment of the present invention.

FIG. 17 is a side view, front view, and perspective view of a gasket 5500 included in the power supply apparatus for an LED light according to an embodiment of the present invention, and FIG. 18 is a side view of a power supply apparatus for an LED light according to another embodiment of the present invention.

In general, the gasket 5500 refers to means inserted in order to prevent gas or water from leaking from a contact surface between two fixed parts.

More specifically, the gasket 5500 includes a body 5510 and insertion grooves 5501. The number of insertion grooves 5501 may be the same as or greater than the number of connector pins 5310.

One side of each of the connector pins 5310 protruded to the outside of the through holes 5321 is inserted into the insertion groove 5501. The length D of the body 5510 of the gasket 5500 may be the length or more of one side of the connector pin 5310 inserted into the insertion groove 5501.

Furthermore, the insertion grooves 5501 are spaced apart from each other at the same interval as that between the through holes 5321 of the pin support means 5320.

Furthermore, the gasket 5500 may further include packing means 5520 extended in a direction orthogonal to the length direction of the body 5510 by a designated length "a" from the outer circumference of the other end of the body 5510.

In this case, a separation groove 5521 may be provided in the packing means 5520. More specifically, the separation groove 5521 is a groove having a length shorter than "a" provided at the edge of the packing means 5520. There is an advantage that the gasket 5500 and the connector can be easily attached and detached through the separation groove 5521.

Referring to FIG. 18, if an external terminal is separated from the connector 5300 because there is no need for a change of a problem, the gasket 5500 may be connected to the connector 5300, one side of each of the connector pins 5310 is inserted into each of the insertion grooves 5501 of the gasket 5500, and thus the packing means 5520 of the gasket 5500 may closely adhere to a designated area in the circumference of the opening portion 5410 on the outside of the housing 5400.

In this case, the materials of the gasket 5500 may include silicon-series compounds, such as methyl hydrodien silicon, polydimethyl siloxane diol, epoxy-modified silicon oil, carboxyl-modified silicon, methacryl-modified silicon oil, alcohol-modified silicon, mercapto-modified silicon, vinyl-modified silicon, and amino-modified silicon.

Accordingly, the gasket 5500 can prevent deformation of the connector pins 5310 along with the pin support means 5320. In particular, if a power supply apparatus for an outdoor LED light is installed outdoors, the lifespan of the power supply apparatus can be extended by preventing rainwater or dust from permeating into the housing 5400 through the opening portion 5410 of the housing 5400.

The invention claimed is:

1. A power supply apparatus for an LED light, comprising:

a printed circuit board on which a circuit converting input power into output power for driving an LED light has been printed;

an MCU which comprises a driving voltage port, a ground port, and a voltage sensing port, which is connected to the printed circuit board, and which transfers a control signal for converting an electric current applied to the LED light to the circuit based on a voltage inputted to the voltage sensing port;

a first resistor which has one end connected to the driving voltage port and has another end connected to the voltage sensing node;

a second resistor which has one end connected to the ground port and has another end connected to the voltage sensing node;

a sensing wire which has one end connected to the voltage sensing port and has another end connected to the voltage sensing node;

a first wire which has one end connected to the one end of the first resistor and has another end open;

a second wire which has one end connected to the one end of the second resistor and has another end open;

a third wire which comprises a third resistor, wherein the third resistor has one end connected to the voltage sensing node and has another end open; and a housing on which the printed circuit board, the MCU, the first resistor, the second resistor, the third resistor, and the sensing wire are mounted in an internal space of the housing.

2. The power supply apparatus of claim 1, wherein:

an opening portion is provided on one side of the housing, and the other ends of the first to the third wires are extended to an outside of the housing through the opening portion.

3. The power supply apparatus of claim 2, further comprising a first connector comprising:

a coupling unit to which the other ends of the first to the third wires are coupled; and first to third guide grooves into which pins of a second connector are inserted, wherein the first to the third guide grooves are extended up to the other ends of the first to the third wires, respectively.

4. The power supply apparatus of claim 3, wherein at least one corner of a body of the first connector is bent or protruded in response to a shape of a body of the second connector or at least one corner of the guide groove is bent or protruded in response to a shape of the pin of the second connector so that an erroneous connection of the second connector is blocked.

5. The power supply apparatus of claim 3, wherein:

the second connector comprises first and second pins coupled together, the first pin is inserted into the third guide groove, and the second pin is inserted into any one of the first and the second guide grooves.

6. The power supply apparatus of claim 5, wherein the first and the second pins electrically connect the other end of the third wire to the other end of any one of the first wire and the second wire.

7. A power supply apparatus for an LED light, comprising:

a printed circuit board on which a circuit converting input power into output power for driving an LED light has been printed;

an MCU which comprises a driving voltage port, a ground port, and a voltage sensing port, which is connected to the printed circuit board, and which transfers a control signal for converting an electric current applied to the LED light to the circuit based on a voltage inputted to the voltage sensing port;

a first resistor which has one end connected to the driving voltage port and has another end connected to the voltage sensing node;

a second resistor which has one end connected to the ground port and has another end connected to the voltage sensing node;

a sensing wire which has one end connected to the voltage sensing port and has another end connected to the voltage sensing node;

a first wire which has one end connected to the one end of the first resistor and has another end open;

a second wire which has one end connected to the one end of the second resistor and has another end open;

a third wire which has one end connected to the voltage sensing node and has another end open; and a housing on which the printed circuit board, the MCU, the first resistor, the second resistor, and the sensing wire are mounted in an internal space of the housing.

8. The power supply apparatus of claim 7, further comprising a first connector comprising a coupling unit to which the other ends of the first to the third wires are coupled and first to third guide grooves into which pins of a second connector are inserted, wherein:

the first to the third guide grooves are connected to the other ends of the first to the third wires, respectively, the second connector comprises a third resistor and first and second pins connected to both ends of the third resistor, the first pin is inserted into the third guide groove, and the second pin is inserted into any one of the first and the second guide grooves.

9. The power supply apparatus of claim 8, wherein the first and the second pins electrically connect the other end of the third wire to the other end of any one of the first wire and the second wire.

* * * * *